US011577532B2

(12) United States Patent
Chen

(10) Patent No.: US 11,577,532 B2
(45) Date of Patent: Feb. 14, 2023

(54) TENSION APPLYING DEVICE, SHEET CONVEYANCE DEVICE, AND IMAGE FORMING APPARATUS

(71) Applicant: Bingxian Chen, Kanagawa (JP)

(72) Inventor: Bingxian Chen, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/471,530

(22) Filed: Sep. 10, 2021

(65) Prior Publication Data

US 2022/0111669 A1 Apr. 14, 2022

(30) Foreign Application Priority Data

Oct. 13, 2020 (JP) ..... JP2020-172628

(51) Int. Cl.
*B41J 15/16* (2006.01)
*B41J 15/04* (2006.01)
(Continued)

(52) U.S. Cl.
CPC ..... *B41J 15/165* (2013.01); *B41J 15/048* (2013.01); *B65H 23/16* (2013.01); *B65H 23/188* (2013.01);
(Continued)

(58) Field of Classification Search
CPC ..... B41J 15/165; B41J 15/048; B65H 23/16; B65H 23/188; B65H 23/1888; B65H 23/198; B65H 23/063; B65H 23/105; B65H 23/1825; B65H 23/1955; B65H 59/30; B65H 2404/1452; B65H 2801/03
See application file for complete search history.

(56) References Cited

U.S. PATENT DOCUMENTS

2019/0276261 A1* 9/2019 Aoki ..... B65H 18/08
2019/0315588 A1* 10/2019 Amari ..... B65H 23/16

FOREIGN PATENT DOCUMENTS

CN 211416677 * 9/2020 ..... B41J 11/00
CN 211416677 U 9/2020
(Continued)

OTHER PUBLICATIONS

Extended European Search Report dated Mar. 21, 2022 issued in corresponding European Application No. 21202161.2.

*Primary Examiner* — Henok D Legesse
(74) *Attorney, Agent, or Firm* — Harness Dickey & Pierce, P.L.C.

(57) ABSTRACT

A tension applying device is attached to a sheet conveyance device. The sheet conveyance device includes a feeding roller for feeding a continuous-form sheet and a winding roller for winding the continuous-form sheet fed from the feeding roller. The tension applying device applies tension to the continuous-form sheet between the feeding roller and the winding roller. The tension applying device includes a guide rail, a slider, a tension bar, and an angle adjustment mechanism. The guide rail is inclined downward toward a continuous-form sheet. The slider slides along the guide rail. The tension bar is supported by the slider and brought into pressure contact with the continuous-form sheet by weight of the slider. The angle adjustment mechanism adjusts an inclination angle of the guide rail with respect to a horizontal direction.

11 Claims, 6 Drawing Sheets

(51) Int. Cl.

| | |
|---|---|
| ***B65H 23/16*** | (2006.01) |
| ***B65H 23/198*** | (2006.01) |
| ***B65H 23/188*** | (2006.01) |
| *B65H 23/06* | (2006.01) |
| *B65H 23/10* | (2006.01) |
| *B65H 23/182* | (2006.01) |
| *B65H 23/195* | (2006.01) |
| *B65H 59/30* | (2006.01) |

(52) U.S. Cl.
CPC ..... *B65H 23/1888* (2013.01); *B65H 23/198* (2013.01); *B65H 23/063* (2013.01); *B65H 23/105* (2013.01); *B65H 23/1825* (2013.01); *B65H 23/1955* (2013.01); *B65H 59/30* (2013.01); *B65H 2404/1452* (2013.01); *B65H 2801/03* (2013.01)

(56) References Cited

FOREIGN PATENT DOCUMENTS

| | | | |
|---|---|---|---|
| JP | 2001-080803 | | 3/2001 |
| JP | 2011-046489 | | 3/2011 |
| JP | 2011-169963 | | 9/2011 |
| JP | 2018-122456 | | 8/2018 |
| KR | 101787086 | B1 | 10/2017 |
| KR | 101849947 | B1 | 4/2018 |
| WO | 2018/139263 | A1 | 8/2018 |

* cited by examiner

TENSION APPLYING DEVICE, SHEET CONVEYANCE DEVICE, AND IMAGE FORMING APPARATUS

CROSS-REFERENCE TO RELATED APPLICATION

This patent application is based on and claims priority pursuant to 35 U.S.C. § 119(a) to Japanese Patent Application No. 2020-172628, filed on Oct. 13, 2020, in the Japan Patent Office, the entire disclosure of which is incorporated by reference herein.

BACKGROUND

Technical Field

Embodiments of the present disclosure relate to a tension applying device, a sheet conveyance device, and an image forming apparatus.

Related Art

There is known an image forming apparatus including a conveyance device for conveying a continuous-form sheet and an image forming device for forming an image on the continuous-form sheet conveyed by the conveyance device. The conveyance device typically includes, for example, a feeding roller for feeding the continuous-form sheet, a winding roller for winding the continuous-form sheet fed from the feeding roller, and a conveyance roller pair for nipping and conveying the continuous-form sheet between the feeding roller and the winding roller.

In such an image forming apparatus, the continuous-form sheet is conveyed by the frictional resistance of the surface of the conveyance roller pair. Accordingly, applying tension to the continuous-form sheet between the feeding roller and the winding roller is necessary. For this reason, the image forming apparatus further includes a tension applying device for bringing a tension bar into pressure contact with the continuous-form sheet to apply tension to the continuous-form sheet.

In the image forming apparatus, the magnitude of the tension to be applied to the continuous-form sheet by the tension applying device varies depending on the material and thickness of the continuous-form sheet.

SUMMARY

In an aspect of the present disclosure, a tension applying device is attached to a sheet conveyance device. The sheet conveyance device includes a feeding roller for feeding a continuous-form sheet and a winding roller for winding the continuous-form sheet fed from the feeding roller. The tension applying device applies tension to the continuous-form sheet between the feeding roller and the winding roller. The tension applying device includes a guide rail, a slider, a tension bar, and an angle adjustment mechanism. The guide rail is inclined downward toward a continuous-form sheet. The slider slides along the guide rail. The tension bar is supported by the slider and brought into pressure contact with the continuous-form sheet by weight of the slider. The angle adjustment mechanism adjusts an inclination angle of the guide rail with respect to a horizontal direction.

In another aspect of the present disclosure, an image forming apparatus includes the sheet conveyance device and an image forming device. The image forming device forms an image on a continuous-form sheet at a position between the tension applying device and the winding roller in a conveyance path of the continuous-form sheet.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
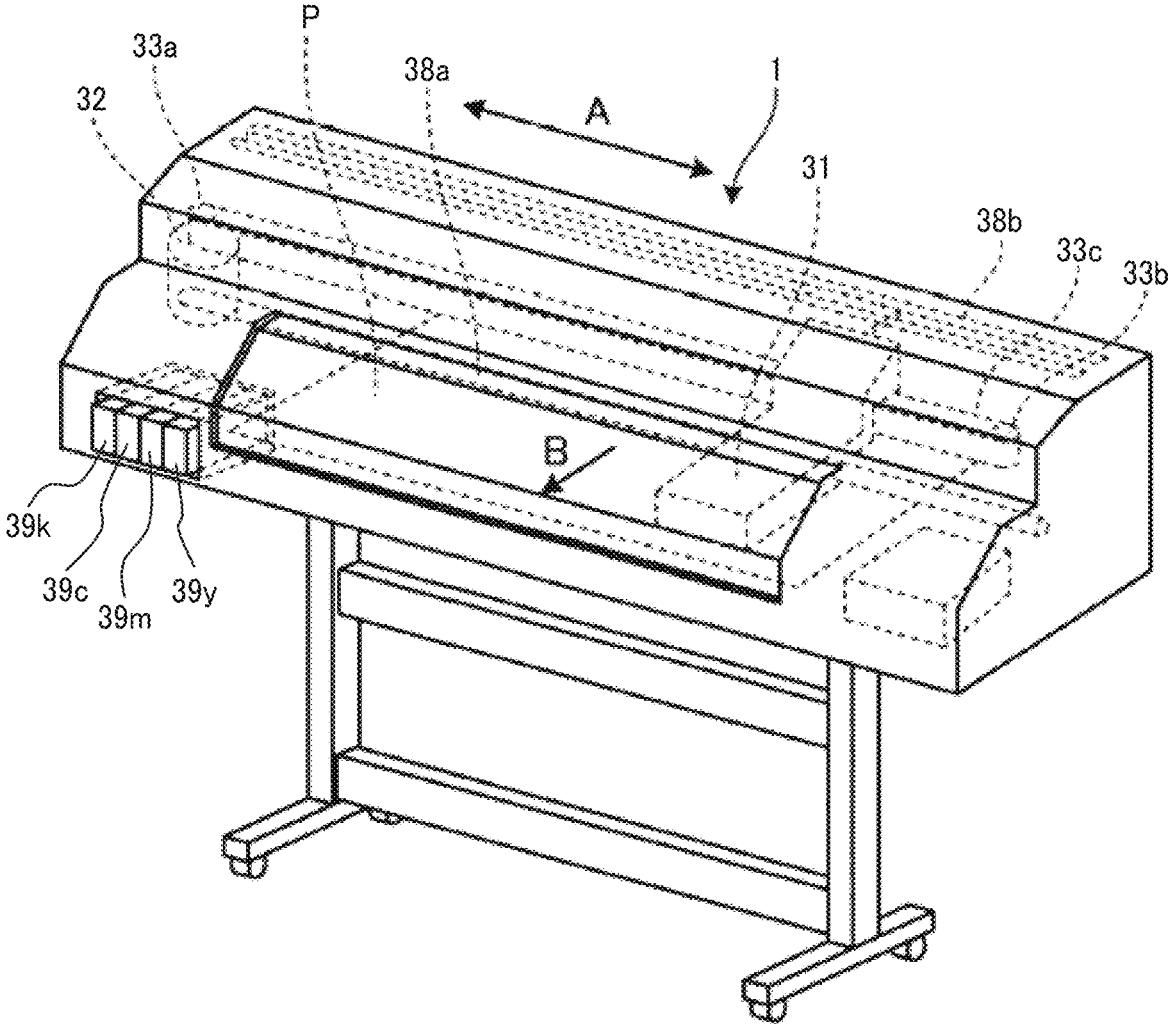
FIG. 1 is a perspective view of an overall configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Referring now to the drawings, embodiments of the present disclosure are described below. As used herein, the singular forms "a," "an," and "the" are intended to include the plural forms as well, unless the context clearly indicates otherwise.

Hereinafter, an image forming apparatus 1 according to an embodiment of the present disclosure is described with reference to FIGS. 1, 2, and 3.

FIG. 1 is a perspective view of an overall configuration of an image forming apparatus 1 according to the present embodiment.

Figure 2:
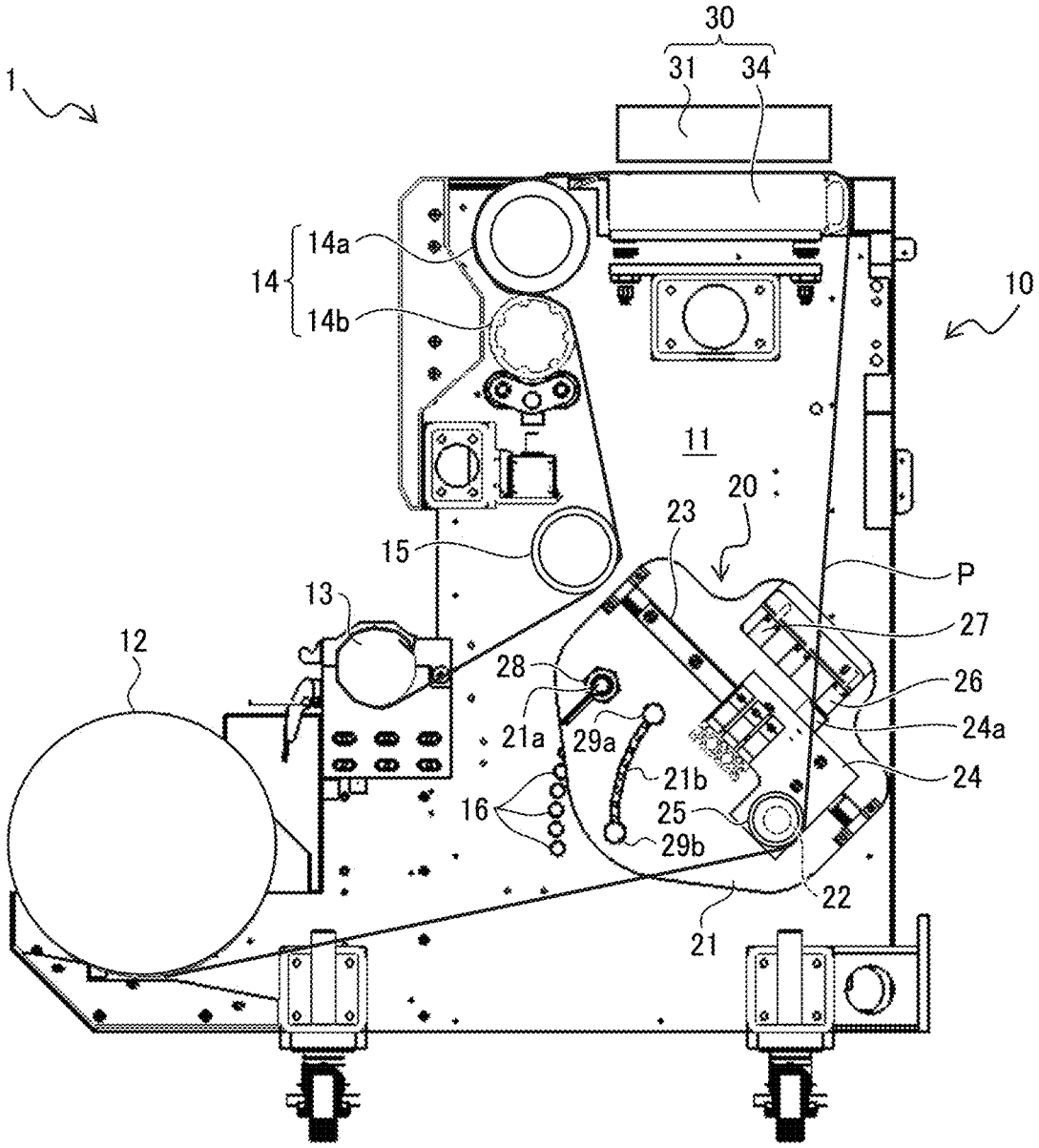
FIG. 2 is a vertical cross-sectional view of a sheet conveyance device provided for an image forming apparatus, according to an embodiment of the present disclosure.

FIG. 2 is a vertical cross-sectional view of a sheet conveyance device 10 provided for the image forming apparatus 1 according to the present embodiment.

Figure 3:
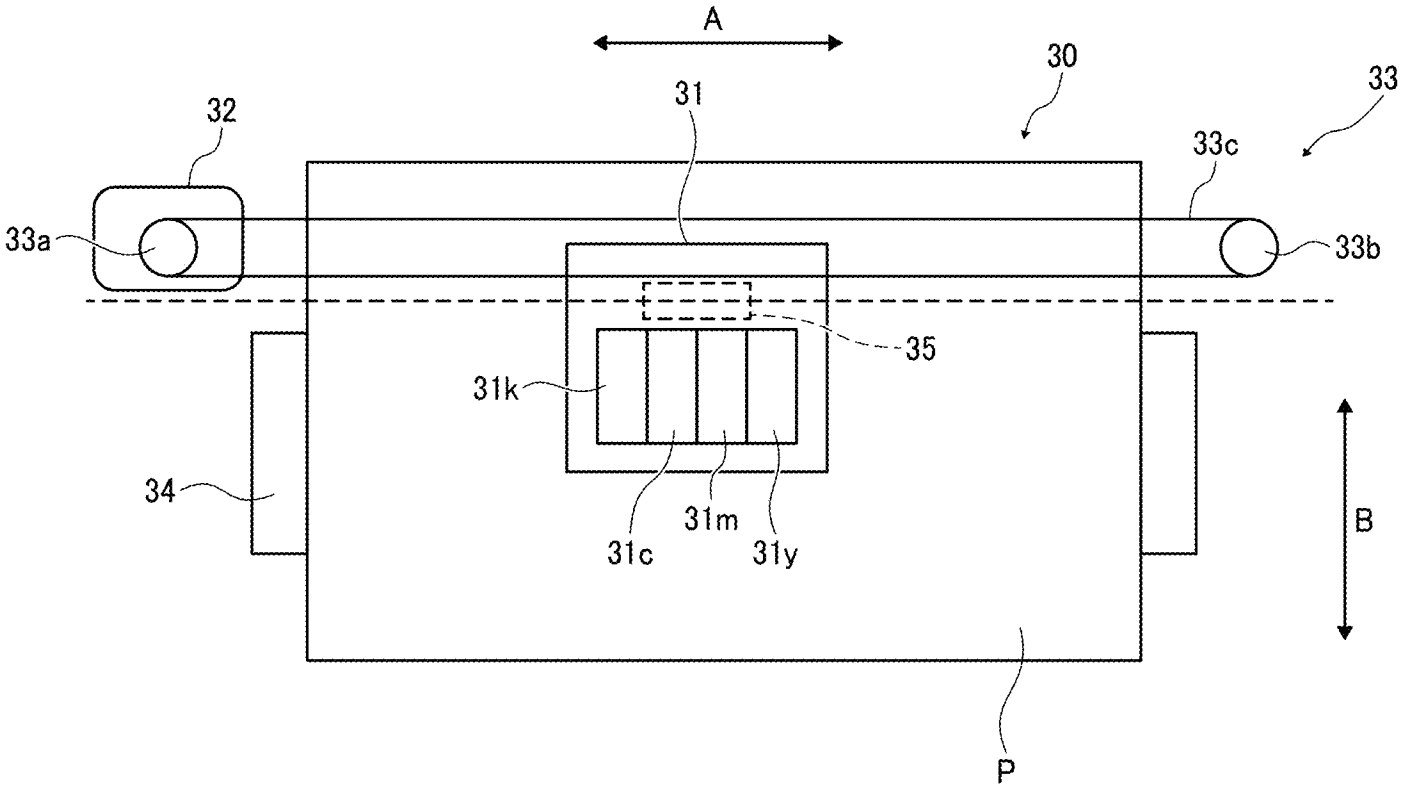
FIG. 3 is a plan view of a detailed configuration of an image forming device provided for an image forming apparatus, according to an embodiment of the present disclosure.

FIG. 3 is a plan view of a detailed configuration of an image forming device 30 provided for the image forming apparatus 1, according to the present embodiment.

The image forming apparatus 1 according to embodiments of the present disclosure is an ink jet image forming apparatus that discharges ink onto a continuous-form sheet P to form an image on the continuous-form sheet P. However, the image forming method of the image forming apparatus 1 is not limited to the inkjet method. For example, an electrophotographic method may be employed. The continuous-form sheet P is a band-shaped sheet. Examples of the material of the continuous-form sheet P include paper (sheet of paper), an overhead projector transparency sheet, thread, fiber, leather, metal, and plastic.

As illustrated in FIGS. 1, 2, and 3, the image forming apparatus 1 typically includes a sheet conveyance device 10 that conveys the continuous-form sheet P, and an image forming device 30 that forms an image on the continuous-form sheet P conveyed by the sheet conveyance device 10.

As illustrated in FIG. 2, the sheet conveyance device 10 mainly includes a frame 11, a feeding roller 12, a winding roller 13, a conveyance roller pair 14, a guide roller 15, and a tension applying device 20. The frame 11 supports a housing of the sheet conveyance device 10 or the image forming apparatus 1. The feeding roller 12, the winding roller 13, the conveyance roller pair 14, the guide roller 15, and the tension applying device 20 are supported by the frame 11.

A plurality of positioning holes 16 are formed on the frame 11 of the sheet conveyance device 10. The multiple positioning holes 16 are arranged along an arc about a rotation shaft 22 described later. The multiple positioning holes 16 are arranged at predetermined intervals, for example, at intervals of 5°. However, the interval between each of the multiple positioning holes 16 is not limited to the above-described example.

The continuous-form sheet P before bearing an image is wound around the feeding roller 12. The feeding roller 12 receives the rotational driving force of the feeding motor to feed the wound continuous-form sheet P by a predetermined amount. The continuous-form sheet P on which an image has been formed is wound around the winding roller 13. The winding roller 13 receives the rotational driving force of a winding motor to wind the continuous-form sheet P fed from the feeding roller 12.

The conveyance roller pair 14 is disposed between the feeding roller 12 and the winding roller 13 in the conveyance path of the continuous-form sheet P. The conveyance roller pair 14 includes a driving roller 14*a* and a pressure roller 14*b*. The driving roller 14*a* is rotated by the rotational driving force of the conveyance motor. The pressure roller 14*b* is pressed against the driving roller 14*a* with the continuous-form sheet P interposed therebetween and is driven to rotate by the rotation of the driving roller 14*a*. Accordingly, the conveyance roller pair 14 conveys the continuous-form sheet P, which is held between by the frictional resistance of the surfaces of the driving roller 14*a* and the pressure roller 14*b*, from the feeding roller 12 toward the winding roller 13.

The guide roller 15 is disposed between the conveyance roller pair 14 and the winding roller 13 in the conveyance path of the continuous-form sheet P. The guide roller 15 contacts the continuous-form sheet P conveyed by the conveyance roller pair 14 to be driven to rotate. The guide roller 15 guides the continuous-form sheet P conveyed by the conveyance roller pair 14.

The tension applying device 20 is disposed between the feeding roller 12 and the winding roller 13, more specifically between the feeding roller 12 and the conveyance roller pair 14, in the conveyance path of the continuous-form sheet P. The tension applying device 20 applies a predetermined tension to the continuous-form sheet P. Further, the tension applying device 20 according to the present embodiment can adjust to increase or decrease the magnitude of the tension applied to the continuous-form sheet P. Details of the tension applying device 20 is described later.

The image forming device 30 is disposed between the feeding roller 12 and the winding roller 13, more specifically between the tension applying device 20 and the conveyance roller pair 14, in the conveyance path of the continuous-form sheet P. As illustrated in FIGS. 1, 2, and 3, the image forming device 30 includes a carriage 31, a main scanning motor 32, a drive force transmission mechanism 33, a platen 34, and an encoder sensor 35.

The carriage 31 reciprocates in a main scanning direction A along a guide rod 38*a* and a sub guide rail 38*b* extending in the main scanning direction A. Further, recording heads 31*k*, 31*c*, 31*m*, and 31*y* that discharge ink of respective colors (black, cyan, magenta, and yellow) are mounted on the carriage 31. The recording heads 31*k*, 31*c*, 31*m*, and 31*y* discharge ink supplied from ink cartridges 39*k*, 39*c*, 39*m*, and 39*y* toward the continuous-form sheet P supported by the platen 34.

The drive force transmission mechanism 33 transmits the driving force of the main scanning motor 32 to the carriage 31 to move the carriage 31 in the main scanning direction A. More specifically, the drive force transmission mechanism 33 includes a drive pulley 33*a*, a pressure pulley 33*b*, and an endless annular timing belt 33*c*. The drive pulley 33*a* and the pressure pulley 33*b* are separated from each other in the main scanning direction A, and the timing belt 33*c* is looped around the drive pulley 33*a* and the pressure pulley 33*b*.

As the main scanning motor 32 transmits the driving force to the drive pulley 33*a*, the drive pulley 33*a* rotates. Along with rotation of the drive pulley 33*a*, the timing belt 33*c* is rotated to reciprocally move the carriage 31 mounted on the timing belt 33*c* in the main scanning direction A. Further, the pressure pulley 33*b* applies a predetermined tension to the timing belt 33*c*.

The platen 34 is disposed facing the carriage 31 in the vertical direction. The platen 34 supports the continuous-form sheet P conveyed in a sub-scanning direction B by the sheet conveyance device 10. The encoder sensor 35 is mounted on the carriage 31. The encoder sensor 35 reads an encoder sheet provided at a position facing the carriage 31 and outputs a pulse signal indicating a read number of rotations of the encoder sensor 35 to the controller.

As illustrated in FIG. 2, the tension applying device 20 typically includes a bracket 21, the rotation shaft 22, an LM guide 23 as a guide rail, a slider 24, a tension bar 25, position sensors 26 and 27, and an index plunger 28 as a fixing member.

The bracket 21 has a flat plate-shape. The bracket 21 supports the rotation shaft 22, the LM guide 23, the slider 24, the tension bar 25, and the position sensors 26 and 27, and is supported by an inner wall of the frame 11 of the sheet conveyance device 10. The rotation shaft 22 is fixed to the bracket 21 and rotatably supported by the frame 11. In other words, the bracket 21 is rotatably supported by the frame 11 via the rotation shaft 22.

A through hole 21*a* and an elongated hole 21*b* are formed on the bracket 21. The through-hole 21*a* and the elongated hole 21*b* penetrate the bracket 21 in the direction of thickness of the bracket 21. The through hole 21*a* communicates with one of the multiple positioning holes 16 formed on the frame 11 as the bracket 21 rotates. The elongated hole 21*b* extends in an arc shape around the rotation shaft 22.

The index plunger 28 is inserted into one of the positioning holes 16 and the through hole 21*a*, which communicates with each other, to fix the bracket 21 to the frame 11 at a predetermined rotation angle. Further, bolts 29*a* and 29*b* are inserted into both ends of the elongated hole 21*b*, and screwed into bolt holes of the frame 11 to doubly fix the bracket 21 to the frame 11. The bracket 21, the rotation shaft 22, the index plunger 28, and the bolts 29*a* and 29*b* constitute an angle adjustment mechanism.

The LM guide 23 is a rod-shaped member extending linearly. The LM guide 23 is fixed to the bracket 21 so as to be inclined downward toward the continuous-form sheet P. The inclination angle θ of the LM guide 23 with respect to the horizontal direction changes as the bracket 21 rotates about the rotation shaft 22.

The slider 24 is supported by the LM guide 23. The slider 24 slides along the LM guide 23. More specifically, the slider 24 descends obliquely downward toward the continuous-form sheet P, by its own weight, and ascends obliquely upward by the reaction force received from the continuous-form sheet P. The slider 24 is a rigid body having a weight corresponding to the tension applied to the continuous-form sheet P.

The tension bar 25 is fixed to the slider 24. The tension bar 25 is a bar-shaped member extending in the width direction of the continuous-form sheet P. The length of the tension bar 25 in the longitudinal direction is set to a length that allows the tension bar 25 to fully contact the continuous-form sheet P across the width of the continuous-form sheet P. When the slider 24 is lowered by its own weight, an outer peripheral surface of the tension bar is brought into pressure contact with the continuous-form sheet P. In other words, the tension bar 25 contacts the continuous-form sheet P in the width direction of the continuous-form sheet P and presses the continuous-form sheet P in a direction in which the slider 24 is lowered. Such a pressing force described above applies a predetermined tension to the continuous-form sheet P. The rotation shaft 22 is disposed at a position coaxial with the tension bar 25 when the slider 24 is at a lower end.

The slider 24 includes a to-be-detected portion 24*a* made of metal. The position sensor 26 is disposed at a position facing the to-be-detected portion 24*a* when the slider 24 is at the lower end. The position sensor 27 is disposed at a position facing the to-be-detected portion 24*a* when the slider 24 is at the upper end. Then, each of the position sensors 26 and 27 outputs a detection signal to the controller when the to-be-detected portion 24*a* approaches the position sensor 26 or the position sensor 27.

In other words, the position sensors 26 and 27 detect the position of the slider 24. More specifically, the position sensor 26 detects that the slider 24 has reached the lower end, and the position sensor 27 detects that the slider 24 has reached the upper end. Note that the specific configuration of the position sensors 26 and 27 is not limited to a proximity sensor. Instead, an optical sensor that detects reflected light or transmitted light may be employed.

The operation of the image forming apparatus 1 is controlled by the controller. In an alternative embodiment, the controller may include a memory that stores a program and a central processing unit that reads the program from the memory and executes the program. Alternatively, the controller may include a field-programmable gate array. Alternatively, the controller may be a combination of the above alternative embodiments. The operations of the image forming apparatus 1, in particular, the operations of the sheet conveyance device 10 are described below with reference to FIGS. 4A and 4B.

Figure 4A:
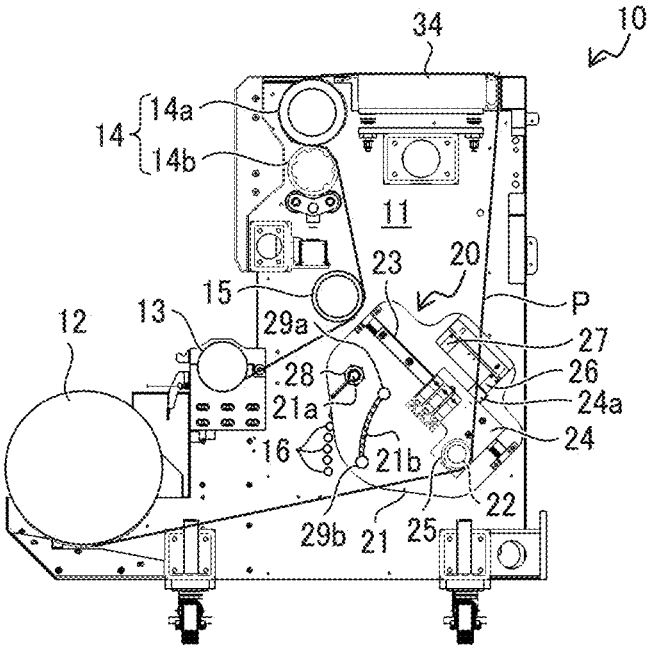
FIG. 4A and FIG. 4B are vertical cross-sectional views of a sheet conveyance device provided for an image forming apparatus illustrating the movement of the tension applying device during the operation process of the sheet conveyance device, according to an embodiment of the present disclosure.
Figure 4B:
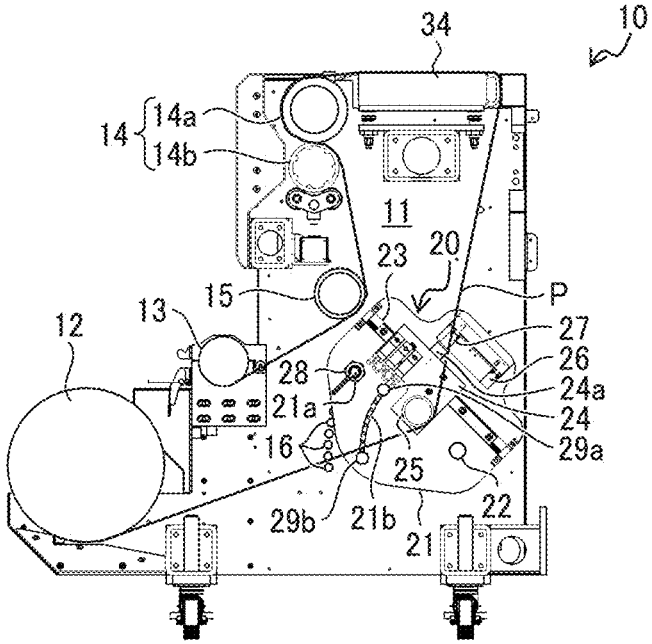

FIG. 4A and FIG. 4B are vertical cross-sectional views of the sheet conveyance device 10 provided for the image forming apparatus 1 illustrating the movement of the tension applying device 20 during the operation process of the sheet conveyance device 10 according to the present embodiment.

First, the controller drives the feeding motor to feed the continuous-form sheet P having a predetermined length from the feeding roller 12. If that happens, the continuous-form sheet P between the feeding roller 12 and the conveyance roller pair 14 is longer and loose. Accordingly, a force applied to the tension bar 25 by the continuous-form sheet P, which is a "reaction force" against the force to move the tension bar 25 by the lowering of the slider 24, is weakened. As a result, the slider 24 descends in an inclined direction. Then, as illustrated in FIG. 4A, the controller stops the feeding motor at a timing when the slider 24 reaches the lower end, in other words, when the detection signal is output from the position sensor 26.

The controller drives the conveyance motor to cause the conveyance roller pair 14 to convey the continuous-form sheet P by a predetermined conveyance width. Further, the controller constantly drives the winding motor with a predetermined torque. When the conveyance roller pair 14 conveys the continuous-form sheet P by the predetermined conveyance width, the continuous-form sheet P fed from the feeding roller 12 moves toward the winding roller 13 by the conveying width. Then, the winding roller 13 winds the continuous-form sheet P conveyed by the conveyance roller pair 14. For this reason, the reaction force from the continuous-form sheet P wound around the winding roller 13 is increased. As a result, the slider 24 ascends along the inclined direction.

As illustrated in FIG. 4B, the controller drives the feeding motor again at a timing when the slider 24 reaches the upper end (in other words, when the detection signal is output from the position sensor 27), and feeds the continuous-form sheet P from the feeding roller 12. Then, the controller repeats the above-described processing to convey the continuous-form sheet P.

Further, the controller causes the image forming device 30 to record an image on the continuous-form sheet P supported by the platen 34. More specifically, the controller drives the main scanning motor 32 to move the carriage 31 in the main scanning direction A, and causes the recording heads 31*k*, 31*c*, 31*m*, and 31*y* to discharge ink at predetermined timings.

Next, the relationship between the inclination angle θ of the LM guide 23 and tension F applied to the continuous-form sheet P is described with reference to FIGS. 5 and 6.

Figure 5:
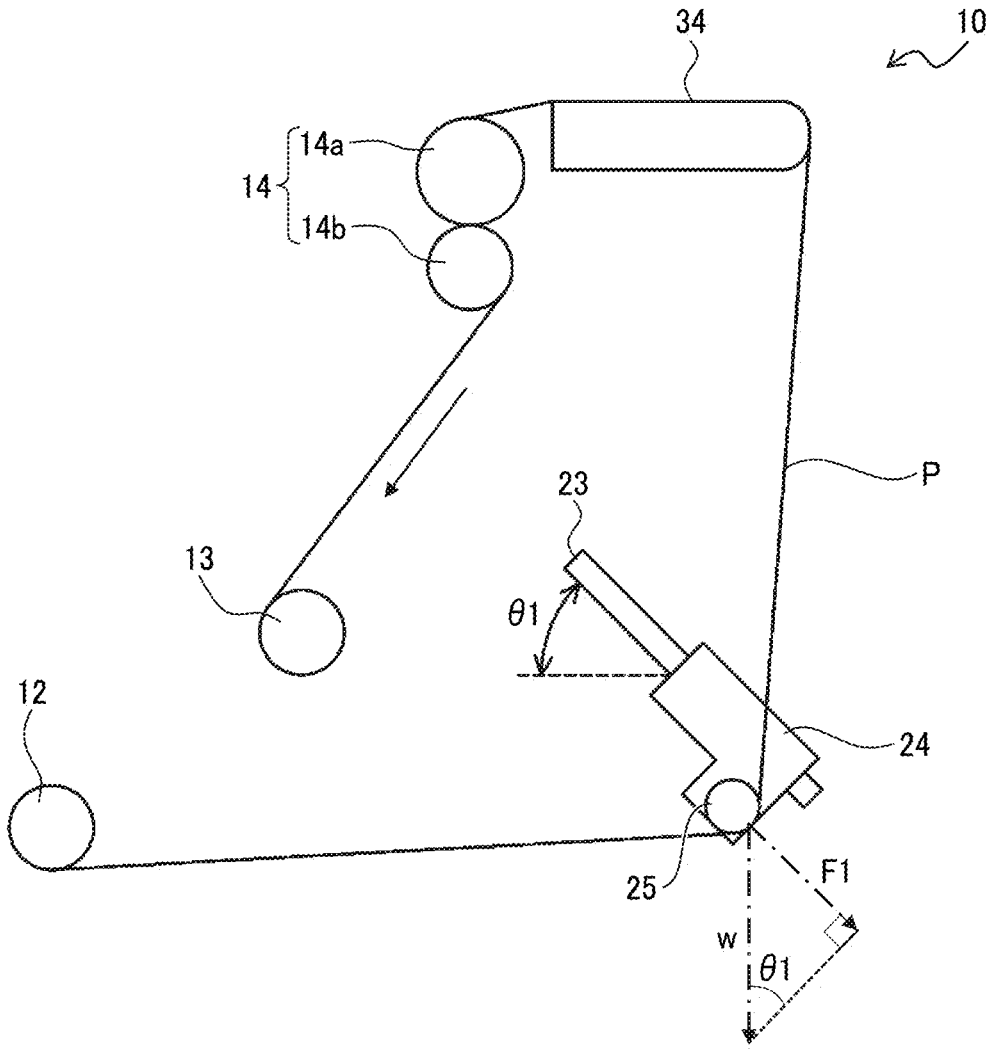
FIG. 5 is a schematic diagram of a sheet conveyance device, illustrating the magnitude of tension F1 when an LM guide has an inclination angle θ1, according to an embodiment of the present disclosure.

FIG. 5 is a schematic diagram of the sheet conveyance device 10 illustrating the magnitude of tension F1 when the LM guide 23 has the inclination angle θ1 according to the present embodiment.

Figure 6:
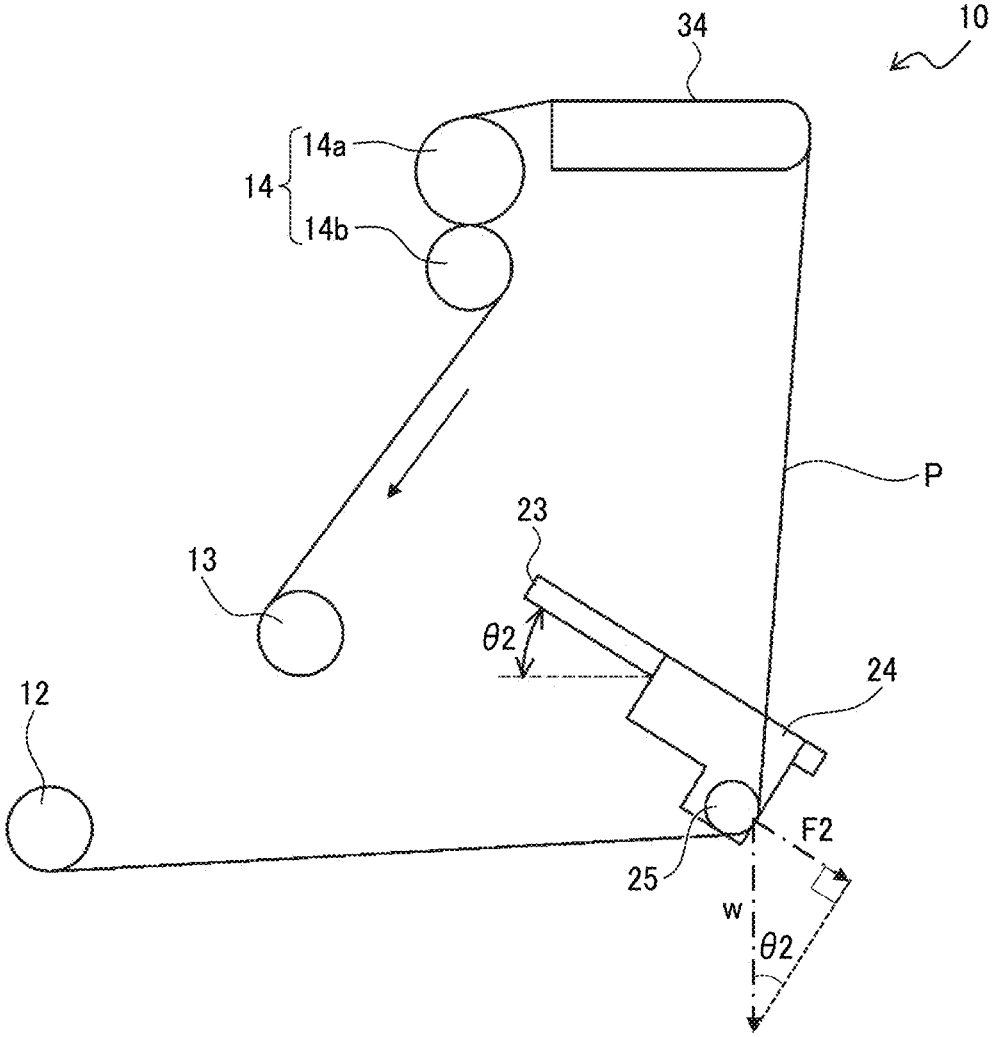
FIG. 6 is a schematic diagram of a sheet conveyance device illustrating the magnitude of tension F2 when an LM guide has an inclination angle θ2, according to an embodiment of the present disclosure.

FIG. 6 is a schematic diagram of the sheet conveyance device 10 illustrating the magnitude of tension F2 when the LM guide 23 has an inclination angle θ2 according to the present embodiment.

As illustrated in FIGS. 5 and 6, when the inclination angle of the LM guide 23 with respect to the horizontal direction is 0 and the weights of the slider 24 and the tension bar 25 are w, the tension F applied to the continuous-form sheet P from the tension applying device is expressed by a first formula as described below.

First Formula

According to the first formula, F=0.50 w when θ=30°, F≈0.71 w when θ=45°, and F≈0.87 w when θ=60°. As described above, as the inclination angle θ of the LM guide 23 increases, the tension F applied from the tension applying device 20 to the continuous-form sheet P increases. In other words, F1 is larger than F2 (F1>F2).

The magnitude of the tension F to be applied to the continuous-form sheet P by the tension applying device 20 changes depending on the material (for example, hardness) and thickness of the continuous-form sheet P. More specifically, the tension F is set to be larger as the continuous-form sheet P is harder and is set to be larger as the continuous-form sheet P is thicker. For example, when the material of the continuous-form sheet P is Polyvinyl chloride (PVC), the inclination angle θ is set to 30°. When the material of the continuous-form sheet P is polyethylene terephthalate harder than PVC, the inclination angle θ is set to 45°. However, the specific relationship between the continuous-form sheet P and the inclination angle θ is not limited to the example described above.

According to the above-described embodiment, for example, the following operational effects are achieved.

According to the above-described embodiment, adjusting the inclination angle θ of the LM guide 23 by the angle adjustment mechanism (the bracket 21, the rotation shaft 22, the index plunger 28, and the bolts 29*a* and 29*b*) allows to adjust the tension F applied to the continuous-form sheet P. As another method of adjusting the tension F, there is a method of attaching and detaching a weight to and from the slider 24. However, this method has a disadvantage of increasing the size of the tension applying device 20. For this reason, as in the above-described embodiment, adopting the angle adjustment mechanism (the bracket 21, the rotation shaft 22, the index plunger 28, and the bolts 29*a* and 29*b*) for adjusting the inclination angle θ of the LM guide 23 allows the size of the tension applying device 20 to be reduced.

According to the above-described embodiment, the rotation shaft 22 is disposed so as to be coaxial with the tension bar 25 when the slider 24 is at the lower end. Accordingly, even if the inclination angle θ of the LM guide 23 is changed, the contact position between the tension bar 25 and the continuous-form sheet P can be prevented from being changed.

Further, according to the above-described embodiment, communicating the through hole 21*a* with any one of the multiple positioning holes 16 and inserting the index plunger 28 into the one of the positioning holes 16 and the through hole 21*a* communicating each other allows the bracket 21 to be fixed to the frame 11. Thus, adjustment of the inclination angle θ of the LM guide 23 can be facilitated.

According to the embodiment described above, the bracket 21 is doubly fixed to the frame 11 by the index plunger 28 and the bolts 29*a* and 29*b*. Thus, the inclination angle θ of the LM guide 23 can be prevented from being changed accidentally.

According to the above-described embodiment, the position sensors 26 and 27 are attached to the bracket 21 to be unitized with the bracket 21. For this reason, even if the inclination angle θ of the LM guide 23 is changed, the relative positions of the position sensors 26 and 27 and the to-be-detected portion 24*a* do not change. Such a configuration as described above eliminates the need to align the positions of the position sensors 26 and 27 every time the inclination angle θ of the LM guide 23 is adjusted.

Further, according to the above-described embodiment, the inclination angle θ of the LM guide 23 is set to be larger as the continuous-form sheet P is harder. Accordingly, the tension F suitable for the material and the thickness of the continuous-form sheet P can be applied to the continuous-form sheet P.

Note that the present disclosure is not limited to specific embodiments described above, and numerous additional modifications and variations are possible in light of the teachings within the technical scope of the appended claims. While the above-described embodiments illustrate a preferable example, those skilled in the art can realize various modifications from the disclosed contents. Such modifications are within the technical scope of the present disclosure.

What is claimed is:

1. A tension applying device configured to be attached to a sheet conveyance device that includes a feeding roller configured to feed a continuous-form sheet and a winding roller configured to wind the continuous-form sheet fed from the feeding roller, the tension applying device being configured to apply tension to the continuous-form sheet between the feeding roller and the winding roller, the tension applying device comprising:

a guide rail inclined downward toward the continuous-form sheet, the guide rail having a lower end and an upper end;

a slider configured to slide along the guide rail;

a tension bar supported by the slider and brought into pressure contact with the continuous-form sheet by weight of the slider; and an angle adjustment mechanism configured to adjust an inclination angle of the guide rail with respect to a horizontal direction, the angle adjustment mechanism including a bracket rotatably attached to a frame of the sheet conveyance device via a rotation shaft that is coaxial with the tension bar that contacts the continuous-form sheet when the slider is slid on the guide rail to position the slider at the lower end of the guide rail.

2. The tension applying device according to claim 1, wherein the bracket includes a through hole configured to communicate with one of a plurality of positioning holes disposed in the frame of the sheet conveyance device along an arc around the rotation shaft, according to a rotational position of the bracket, and wherein the angle adjustment mechanism includes a fixing member configured to insert into the through hole and the one of the plurality of positioning holes to fix the tension applying device to the frame of the sheet conveyance device.

3. The tension applying device according to claim 2, wherein the bracket includes an elongated hole extending in an arc shape around the rotation shaft, and wherein the tension applying device is further fixed to the frame of the sheet conveyance device with a bolt inserted through the elongated hole.

4. The tension applying device according to claim 1, wherein the tension applying device includes a position sensor fixed to the bracket and configured to detect a position of the slider.

5. The tension applying device according to claim 1, wherein the inclination angle of the guide rail set by the angle adjustment mechanism is larger as the continuous-form sheet fed from the feeding roller is harder.

6. The sheet conveyance device according to claim 1, comprising:

a conveyance roller pair disposed between the feeding roller and the winding roller and configured to nip and convey the continuous-form sheet.

7. An image forming apparatus comprising:

the sheet conveyance device according to claim 6; and an image forming device configured to form an image on the continuous-form sheet at a position between the tension applying device and the winding roller in a conveyance path of the continuous-form sheet.

8. The sheet conveyance device according to claim 1, wherein a contact position between the tension bar and the continuous-form sheet remains same when the inclination angle of the guide rail changes.

9. The sheet conveyance device according to claim 1, wherein the angle adjustment mechanism further comprises:

a fixing member configured to penetrate a through hole in the bracket to secure the tension applying device to one of a plurality of positioning holes in the frame; and a bolt configured to penetrate an elongated hole in the bracket to secure the tension applying device to a bolt hole in the frame, the bolt hole being separate from the positioning holes such that the bracket is doubly secured to the frame via both the fixing member and the bolt.

10. The sheet conveyance device according to claim 9, wherein the elongated hole in the bracket extends in an arc shape around the rotation shaft.

11. The sheet conveyance device according to claim 9, wherein the angle adjustment mechanism is configured to adjust the inclination angle of the guide rail with respect to the horizontal direction only when both fixing member and the bolt are not secured to the frame.

* * * * *